US007891158B2

(12) United States Patent
Stafford, III et al.

(10) Patent No.: US 7,891,158 B2
(45) Date of Patent: Feb. 22, 2011

(54) ROBOTIC MULTI-PRODUCT CASE-PACKING SYSTEM

(75) Inventors: Thomas I. Stafford, III, Roswell, GA (US); Benjamin C. Fordham, Savannah, GA (US); Richard S. Schneider, Brewerton, NY (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/462,435

(22) Filed: Aug. 4, 2009

(65) Prior Publication Data

US 2009/0293433 A1 Dec. 3, 2009

Related U.S. Application Data

(62) Division of application No. 12/043,613, filed on Mar. 6, 2008, now Pat. No. 7,584,589.

(60) Provisional application No. 60/905,960, filed on Mar. 9, 2007.

(51) Int. Cl.
*B65B 35/54* (2006.01)

(52) U.S. Cl. ..... 53/446; 53/154; 53/168; 53/202

(58) Field of Classification Search ..... 53/446, 53/443, 447, 448, 474, 492, 154, 168, 202, 53/237

See application file for complete search history.

(56) References Cited

U.S. PATENT DOCUMENTS

| | | | | |
|---|---|---|---|---|
| 3,137,981 A | | 6/1964 | Johnson et al. | 53/168 |
| 4,369,612 A | | 1/1983 | Wight | |
| 4,413,724 A | | 11/1983 | Fellner | 198/594 |
| 4,499,987 A | | 2/1985 | Long | 198/347 |
| 4,870,807 A | * | 10/1989 | Palamides et al. | 53/528 |
| 4,930,291 A | | 6/1990 | Boisseau | 53/458 |
| 4,972,936 A | | 11/1990 | Kura | |
| 5,018,336 A | * | 5/1991 | Mengotti et al. | 53/435 |
| 5,125,782 A | | 6/1992 | Goldschmidt et al. | |
| 5,170,877 A | * | 12/1992 | Francioni | 198/358 |
| 5,341,626 A | * | 8/1994 | Beckmann | 53/566 |
| 5,617,701 A | | 4/1997 | Brizzi et al. | 53/168 |
| 5,628,162 A | | 5/1997 | Kreusch et al. | 53/168 |
| 5,794,417 A | | 8/1998 | Mohrman | 53/541 |
| 5,996,316 A | | 12/1999 | Kirschner | 53/443 |
| 6,050,062 A | | 4/2000 | Petersson et al. | 53/458 |
| 6,106,450 A | | 8/2000 | Brittain | 493/171 |
| 6,145,281 A | * | 11/2000 | Hansen et al. | 53/447 |

(Continued)

*Primary Examiner*—Paul R Durand
(74) *Attorney, Agent, or Firm*—Laura L. Bozek

(57) ABSTRACT

A case packing system concurrently accumulates a plurality of different product ensembles and sequentially packs cases thereof, generally by way of (a) concurrently accumulating a plurality of different product ensembles utilizing a plurality of product conveyer lines, each of which is adapted to separately convey distinct products to one or more transfer points; (b) sequentially transferring different accumulated product ensembles from the conveyer lines to a case-packer, the case-packer including a packing section as well as multiple magazines for receiving different case-blanks; (c) controlling transfer of the product ensembles to the case-packer and selection of the appropriate case-blank. Preferably, substantially continuous operation of the case-packer at a production rate higher than an accumulation rate of any individual product conveyer is maintained. A preferred construction employs a 4-axis robotic arm to select KDF cases and shuttle conveyers to transfer product from the conveyers to the case-packer.

16 Claims, 2 Drawing Sheets

U.S. PATENT DOCUMENTS

| | | | | |
|---|---|---|---|---|
| 6,516,811 | B1 | 2/2003 | Focke et al. | 131/283 |
| 6,591,587 | B2 * | 7/2003 | Salm et al. | 53/461 |
| 6,656,006 | B2 | 12/2003 | Yamamuro et al. | 445/9 |
| 6,715,265 | B2 * | 4/2004 | Franzaroli | 53/435 |
| 6,751,934 | B2 | 6/2004 | Focke et al. | 53/444 |
| 6,830,145 | B2 | 12/2004 | Flom | 198/617 |
| 6,928,789 | B2 * | 8/2005 | Prakken | 53/154 |
| 6,941,723 | B2 * | 9/2005 | Di Stasio | 53/247 |
| 7,143,567 | B2 * | 12/2006 | Omo et al. | 53/443 |
| 7,219,485 | B2 * | 5/2007 | Battisti | 53/542 |
| 7,389,622 | B2 * | 6/2008 | Douglas | 53/251 |
| 7,587,879 | B2 * | 9/2009 | Guttinger et al. | 53/251 |
| 2002/0073651 | A1 * | 6/2002 | Muller | 53/399 |
| 2005/0198920 | A1 | 9/2005 | Nakagawa et al. | |
| 2006/0053754 | A1 * | 3/2006 | Carrigan et al. | 53/589 |
| 2006/0070353 | A1 * | 4/2006 | Van Dam | 53/447 |
| 2006/0070847 | A1 | 4/2006 | Besch et al. | |
| 2006/0162284 | A1 * | 7/2006 | Nakagawa et al. | 53/168 |
| 2007/0028561 | A1 * | 2/2007 | Douglas | 53/251 |
| 2007/0215435 | A1 | 9/2007 | Tachibana et al. | |
| 2008/0142398 | A1 * | 6/2008 | Carrigan et al. | 206/499 |
| 2009/0241472 | A1 * | 10/2009 | Lindee et al. | 53/443 |

* cited by examiner

ROBOTIC MULTI-PRODUCT CASE-PACKING SYSTEM

CLAIM FOR PRIORITY

This application is a divisional of U.S. patent application Ser. No. 12/043,613, entitled "Robotic Multi-Product Case-Packing System", filed on Mar. 6, 2008, now U.S. Pat. No. 7,584,589. U.S. patent application Ser. No. 12/043,613 was based upon U.S. Provisional Patent Application Ser. No. 60/905,960, also entitled "Robotic Multi-Product Case-Packing System", filed Mar. 9, 2007. The priorities of U.S. patent application Ser. No. 12/043,613 and U.S. Provisional Patent Application Ser. No. 60/905,960 are hereby claimed and the disclosures thereof are incorporated into this application by reference.

TECHNICAL FIELD

The present invention relates to a robotic case packing system adapted to pack multiple products. In one preferred embodiment, the case-packing system includes a plurality of production lines which accumulate product and a plurality of movable shuttle conveyers which selectively provide a predetermined number of units to a case-packer with multiple case-blank magazines such that substantially continuous operation of the case-packer can be maintained, even with low-volume production of individual products. A pivoting robotic arm selects the appropriate case from a magazine so that the system readily switches from packing one product to packing another.

BACKGROUND

Automated cartoning equipment is well known in the art. There is shown, for example, in U.S. Pat. No. 6,050,062 to Petersson et al. a packaging system having multiple magazines for providing different carton blanks to a single form, fill and seal packaging machine. The packaging system has multiple magazines, a packaging machine, a carton opener, and optionally an automatic carton loader. See also, U.S. Pat. No. 5,341,626 to Beckmann. In the '626 patent there is disclosed an apparatus which provides a plurality of different carton blanks to a packing apparatus. The filling of the cartons and the closing of the cartons takes place on a turret having cells which are adjustable in size to match the incoming erected carton. So also, there is disclosed in U.S. Pat. No. 4,930,291 to Boisseau an apparatus having multiple magazines. See FIG. 2. There is disclosed in U.S. Pat. No. 3,137,981 to Johnson et al. a multiple magazine cartoning machine.

The various components of cartoning systems are further described in the following patents.

U.S. Pat. No. 6,830,145 to Flom describes a transfer system including an air conveyer, a servo conveyer and a fan feeder. The air conveyer is located at a first location where it receives package articles from a bagger system or a conveyer system. The servo conveyer abuts the air conveyer and extends to a second location adjacent to a destination point. The fan feeder is located adjacent to the servo conveyer at an end opposite the air conveyer such that the fan feeder lies over a bucket conveyer to a cartoner system.

U.S. Pat. No. 6,751,934 to Focke et al. describes a process for packaging cigarettes packs. The procedure for carrying out a product changeover is such that the entire production and packaging installation is largely emptied. In the region of a film packer and of a following multi-packer, subassemblies for producing web connections are controlled such that the last cigarette pack of an old configuration is assigned to a last cigarette multipack and the product is separated out. See also, U.S. Pat. No. 6,516,811 to Focke et al.

U.S. Pat. No. 5,996,316 to Kirschner describes a packaging system with a subsystem for packaging individual articles into different sized containers, the different sized containers having a different number of individual articles therein. This system also includes a palletizer for palletizing the different sized containers and a conveyer system for transporting the articles from the supply to the packaging subsystem and for transporting the containers from the packaging subsystem to the palletizer.

U.S. Pat. No. 5,794,417 to Mohrman discloses an adjustable case-packer. The device includes a telescoping stacking chamber with a telescoping base plate having sensors for detecting a full layer and means for raising the telescoping base plate in order to pack a carton.

U.S. Pat. No. 5,628,162 to Kreusch et al. discloses a packaging system for packaging a plurality of different cigarette types including multiple packaging units arranged in a side by side relationship. See also, U.S. Pat. No. 5,617,701 to Brizzi et al.

U.S. Pat. No. 4,499,987 to Long discloses an accumulator system for cartons moving to a case-packer including a conveyer section interposed in a conveying line. When a jam is detected on the delivery conveyer, a stop member is activated to prevent movement of cartons. When a slug of cartons is accumulated, an array of fingers lifts the slug an increment to clear the accumulator for more cartons from the receiving conveyer. Another accumulator is seen in U.S. Pat. No. 4,413,724 to Fellner which discloses an accumulator including a plurality of side by side conveying lines.

Due to prohibitive capital costs, conventional case-packing systems are unsuitable for low volume product lines because such systems remain idle for much of the time. Such products are thus conventionally hand-packed into cases for delivery to customers. The present invention provides a case packing system and method wherein multiple products are concurrently accumulated and sequentially packed in cases through robotic selection of the production line and appropriate case for the particular product.

SUMMARY OF INVENTION

There is provided in accordance with the present invention an apparatus and method of concurrently accumulating a plurality of different product ensembles and sequentially packing cases thereof. Generally, the process and system involves: (a) concurrently accumulating a plurality of different product ensembles utilizing a plurality of product conveyer lines, each of which is adapted to separately convey distinct products to one or more transfer points; (b) sequentially transferring different accumulated product ensembles from the conveyer lines to a case-packer, the case-packer including a packing section as well as multiple magazines for receiving different case-blanks; (c) robotically controlling transfer of the product ensembles to the case-packer and selection of the appropriate case-blank; and (d) maintaining operation of the case-packer at a production rate higher than an accumulation rate of any individual product conveyer of the system. The system thus makes it practical to automate case packing even for low-volume product lines since machine time is efficiently utilized. Preferably, the case-packer is supplied with enough products such that it operates substantially continuously.

BRIEF DESCRIPTION OF DRAWINGS

The invention is described in detail below with reference to the drawings, wherein like numbers designate similar parts and wherein.

DETAILED DESCRIPTION

Figure 1:
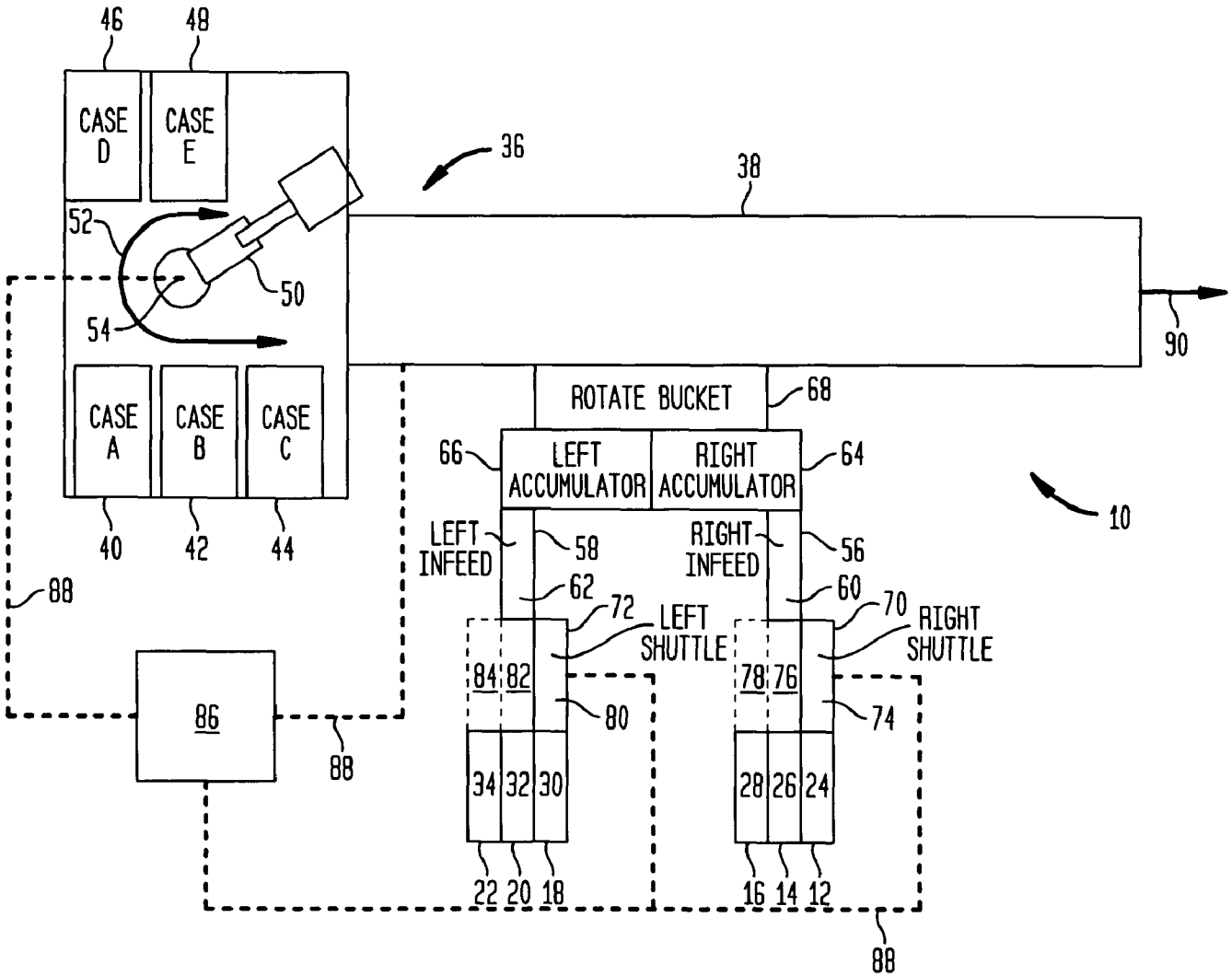
FIG. 1 is a schematic diagram of an embodiment of a robotic case-packing system of the present invention.

The invention is described in detail below with reference to several embodiments and numerous examples. Such discussion is for purposes of illustration only. Modifications to particular examples within the spirit and scope of the present invention, set forth in the appended claims, will be readily apparent to one of ordinary skill in the art. As is noted above, case-packers and associated equipment are well-known. See U.S. Pat. No. 5,341,626 to Beckmann, the disclosure of which is incorporated herein by reference, where there is disclosed a case-packer with a carton erector. Various carton erectors are also seen in U.S. Pat. No. 6,106,450 to Britain and U.S. Pat. No. 6,656,006 to East, the disclosures of which are also incorporated herein by reference. U.S. Pat. No. 5,794,417 to Mohrman (likewise incorporated herein by reference) discloses an adjustable case-packer. The device includes a telescoping stacking chamber with a telescoping base plate having sensors for detecting a full layer and means for raising the telescoping base plate in order to pack a carton. Such components can be incorporated into the inventive system, if so desired.

Preferably, products are supplied to the case-packer such that operation of the case-packer is "substantially continuous" in the sense that the packing section of the case-packer is idle no more than 25% of the time during a production campaign.

The present invention is adapted, in a preferred embodiment, to pack paper products, such as napkins, towels and so forth into cases formed from knock-down-flat (KDF) blanks having, for example, different indicia for different products or for different customers. KDF cases are loaded into each of a plurality of magazines of a case-packer. The magazines for this system are static using a robotic arm to reach each case. When the proper count of product is sufficient on a particular in-feed, the system will request that the appropriate case be picked from its magazine. This is advantageously accomplished utilizing a 4-axis robot. The robot will go to the requested magazine and select a case, with vacuum, reaching in until it contacts the KDF case blank. It will deliver the case to the KDF staging/squaring station. When that operation is complete the robot will go to a perch position until a request for another case is received. The KDF case blank is optionally scanned for proper bar code (if the bar code is incorrect that case is rejected automatically and the robot is requested to get a new case) and is transferred to the erecting and positioning station, where it is formed into the box shape. Rear minor and major flaps are folded and the case is positioned for automatic loading. Simultaneously, product enters the case-packer's in-feed system as shown in drawing and transported to the collation station where the pack pattern is developed. The product is then loaded into the case. After loading, the case indexes through the machine where the load side minor flaps are folded, hot melt glue is applied, major flaps are pre-folded and then final folded and sealed. The finished sealed case discharges onto a conveyor for distribution. Details are further appreciated by reference to the various Figures.

FIG. 1 is a schematic diagram of a robotic case-packing system 10 of the invention. System 10 includes a plurality of product conveyer lines 12, 14, 16, 18, 20 and 22, each of which is adapted to separately convey distinct products to a plurality of segregated transfer points 24, 26, 28, 30, 32 and 34. Each product conveyer accumulates a collection or ensemble of products at its transfer point.

A case-packer 36 includes a packing section 38, as well as multiple magazines 40, 42, 44, 46 and 48 and a robotic arm 50. The magazines are arranged over an arc 52 which is suitably less than 300° and preferably less than 270°. Robotic arm 50 is pivotally mounted at 54, initially with respect to magazines, such that it rotates between magazines in order to select the appropriate case for the appropriate product ensemble. Case-packer 36 also includes 2 in-feed conveyers 56, 58 with distinct feed points 60, 62 as well as a right accumulator 64 and a left accumulator 66. Further provided is a rotate bucket 68 which takes collated product from a laying flat state and rotates it to stand on end so the product is in a correct orientation for loading into the case.

A pair of shuttle conveyers 70, 72 is movable to a plurality of locations so as to transfer a selected product ensemble from a transfer point of a conveyer to an in-feed conveyer of the case-packer. To this end, shuttle conveyer 70 is movable to locations 74, 76 and 78 while shuttle 72 is movable to positions 80, 82 and 84.

Operation of the system is coordinated by a controller 86 which is coupled to the various components by way of a control bus indicated at 88. Controller 86 controls the various components such that the case-packing system is operable to accumulate different products concurrently and sequentially supply a predetermined number of like product units to the case-packer. System 10 is thus capable of maintaining substantially continuous operation of the case-packer at a production rate higher than the accumulation rate of any individual product conveyer of the system.

Thus, conveyer lines 12, 14, 16, 18, 20, 22 operate concurrently to accumulate different products (which may be similar but labeled differently) at their transfer points. The shuttle conveyers are operated to convey a product ensemble from a selected product conveyer line to an in-feed conveyer. For example, product conveyer line 16 accumulates product at or near its transfer point 28. When a sufficient number of units are available at 28, shuttle conveyer 70 is cylinder activated to move to location 78 and receive the product ensemble. Thereafter, shuttle conveyor 70 is moved to location 76 and provides the selected product ensemble to feed point 60 of in-feed conveyer 56 which, in turn, provides the ensemble to right accumulator 64. When an ensemble is ready to be cased, controller 86 activates robotic arm 50 which selects the appropriate case and provides the appropriate case blank to packing section 38 of case-packer 36, where the case is erected and packed with product. Thereafter, the packed case is sealed and conveyed in direction 90 for distribution.

Figure 2:
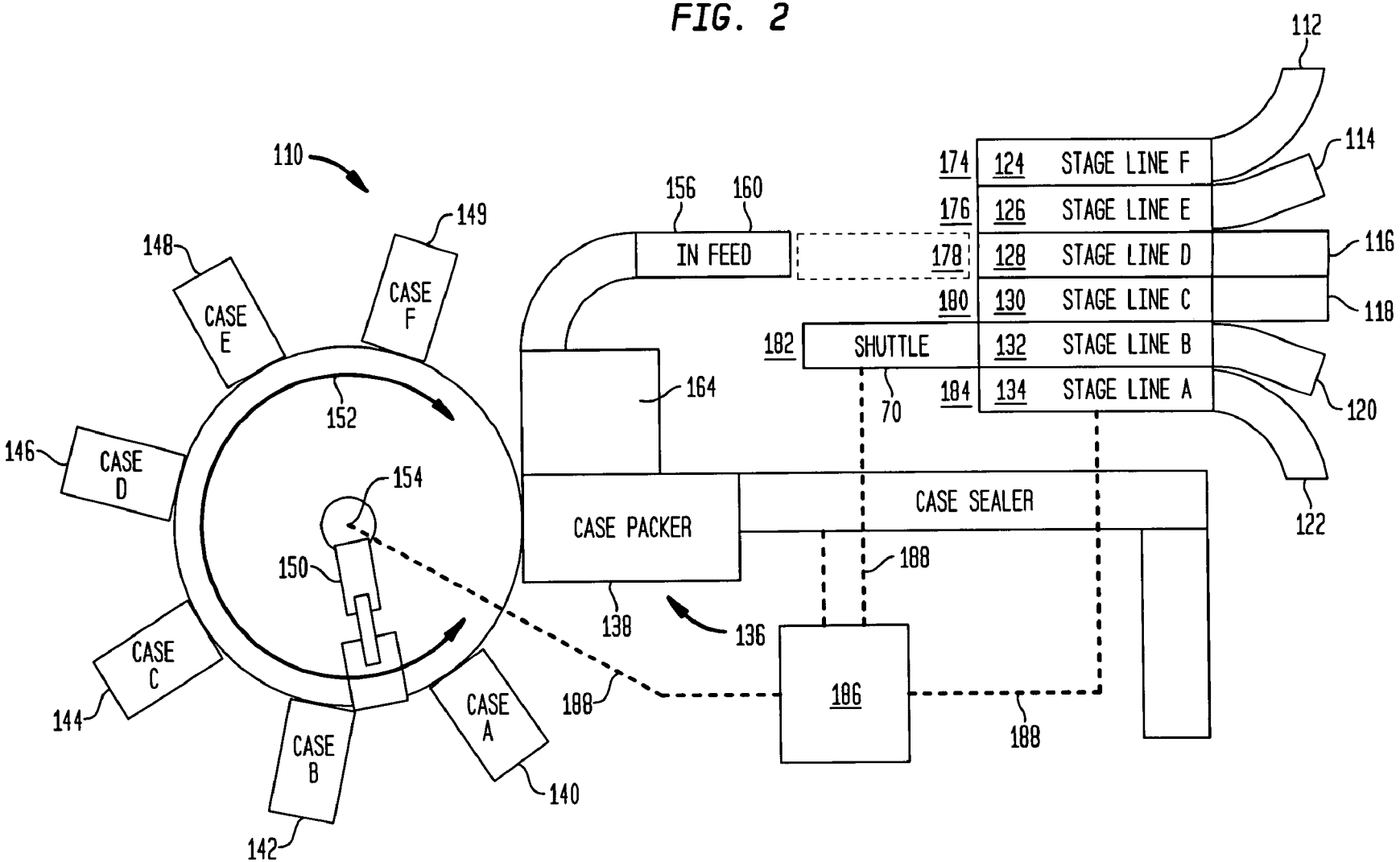
FIG. 2 is a schematic diagram of another embodiment of a robotic case-packing system of the present invention.

An alternate layout for the inventive system is shown in FIG. 2, which shows a system 110 similar in many respects to system 10 of FIG. 1. System 110 includes a plurality of product conveyer lines 112, 114, 116, 118, 120 and 122 having transfer points 124, 126, 128, 130, 132 and 134 as well as a case-packer 136.

Case-packer 136 includes a packing section 138 as well as multiple KDF magazines 140, 142, 144, 146, 148 and 149. Further provided is a robotic arm 150. The magazines are arranged over an arc 152 with suitably less than 300° having at its center robotic arm 150. Arm 150 is pivotally mounted at pivot 154 for rotation so as to be able to select the appropriate case for a product ensemble.

Case-packer 136 also includes an in-feed conveyer 156 with a feed point 160 as well as an accumulator at 164.

A shuttle conveyer 70 is movable to and from a plurality of locations 174, 176, 178, 180, 182 and 184 so as to shuttle a product ensemble to the case-packer when ready.

Operation of system 110 is controlled by a controller 186 connected to the various system components by a control bus 188.

System 110 operates similarly to system 10 of FIG. 1; however, the system operates at a lower maximum speed, somewhat limited by the shuttle conveyer capacity.

The system of the invention is constructed with components which are generally available. For example, robotic arm 50 is suitably a model no. Fanuc M410 robotic arm available from Schneider Packaging Equipment Co. Inc, case-packer 36 is suitably a model HCP-10 case-packer from Schneider Packaging Equipment Co. Inc., while controller 86 is an Allen Bradley Logix's controller. The shuttle conveyers are preferably custom made for a particular installation. The shuttle and staging conveyors are sized to fit the incoming product from the various upstream conveyor lines so there is enough length to them to be able to accept a full case load of product. A product hold located at the in-feed end at each of the staging conveyors stops incoming product from advancing while that staging conveyor releases its product to the shuttle. That is, for example, a product hold (not shown) stops any more products from entering staging conveyor line 16. Shuttle conveyor 70 travels over to position 78 and lines up with conveyor line 16. A blade stop lowers allowing product from conveyor line 16 to enter onto shuttle conveyor 70. When the product has completely exited conveyor line 16 the blade stop raises. The product hold at the in-feed end of conveyor line 16 releases allowing product to enter conveyor line 16. This process is the same for each of the conveyor lines. The conveyor system operates on a first in first out sequence. The controller 86 monitors each conveyor. When a conveyor reaches the proper level indicating it has a full case load of product available it is put into a queue and is serviced by the shuttle.

The inventive system is thus capable of packing different products in different cases with different packing formats and so forth. For example, 5 different products could be packed in 5 different-sized layouts by a single system with one automated case-packer. The system readily switches between different products without the system being idled. One preferred way of operating the system is determining when a caseload of a particular product is available from a product conveyer and placing that case in a queue for transport to the case-packer as will be appreciated from the foregoing.

Example

The system of FIG. 1 is operated with five (5) napkin folding lines running to the multiple-product case packing machine. The lines are commonly referred to as "300 count" lines, but they package printed and non-printed quarter-folded lunch napkins in packages of 250, 330, and 400. Each folding machine converts napkins at a rate of 4800 napkins per minute. At these rates, cases of 12 packages can be produced at rates of 1 to 1.6 cases per minute. Typically, four (4) of the five (5) napkin lines are producing a 250 count package (the most popular configuration). For example conveyor lines 12, 14, 16, 18 might be producing 250 count packages of products A, B, C, D each for different customers with different prints and designations while line 20 is producing a 400 count product E. In this scenario, the case-packer would have to maintain a packing rate of 7.4 cases per minute. In speed tests, the case-packer has exceeded 9 cases per minute, as required for surge rate. A "surge" situation occurs when the case-packer has been powered down or serviced for a short interval, usually less than 15 minutes, and packages accumulate on conveyors feeding the case-packer. In this situation, simply packing at the rate of the folder production capability will not reduce the amount of accumulated product on the conveying lines. If the accumulation is not reduced, the next down-time interval at the case-packer will produce down-time at the folding equipment almost immediately. Thus, with surge capability, the case-packer is capable of eliminating accumulated product.

In exemplary operation, the case-packer is running the following configurations from each line at their designated nominal rate:

A—400 count packages at 12 per minute
B—250 count packages at 18 per minute
C—250 count packages at 18 per minute
D—250 count packages at 18 per minute
E—250 count packages at 18 per minute Each of these configurations is similar in their number of packages and pattern within the case. Where these differ, is in their poly print, case print, and package rate. The case-packer has the capability to change sizes and counts for each line within the constraints of the package pattern in the case.

While the invention has been described in detail in connection with two (2) constructions of the system and exemplary operation thereof, modifications within the spirit and scope of the invention will be readily apparent to those of ordinary skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A method of concurrently accumulating a plurality of different product ensembles and sequentially packing cases thereof, comprising:

(a) concurrently accumulating a plurality of different product ensembles utilizing a plurality of product conveyer lines, each of which is adapted to separately convey distinct products to one or more transfer points;

(b) sequentially transferring different accumulated product ensembles from the conveyer lines to a case-packer, the case-packer including a packing section as well as multiple magazines for receiving different case-blanks;

(c) controlling transfer of the product ensembles to the case-packer and selection of the appropriate case-blank; and (d) maintaining substantially continuous operation of the case-packer at a production rate higher than an accumulation rate of any individual product conveyer of the system.

2. The method according to claim 1, wherein the case-packer is operated at a production rate of at least 3 times that of any individual conveyor line.

3. The method according to claim 1, wherein the case-packer is operated at a production rate of at least 5 times that of any individual conveyor line.

4. The method according to claim 1, wherein the case-packer is operated at a production rate of at least 7 times that of any individual conveyor line.

5. The method according to claim 1, wherein the case-packer is operated at a production rate higher than the collective production rate of the plurality of conveyer lines.

6. The method according to claim 1, utilizing at least 3 product conveyor lines and wherein the case-packer includes at least 3 case-blank magazines.

7. The method according to claim 1, utilizing at least 5 product conveyor lines and wherein the case-packer includes at least 5 case-blank magazines.

8. The method according to claim 1, wherein the case-blank magazines are arranged over an arc of less than 300°.

9. The method according to claim 1, wherein the case-blank magazines are arranged over an arc of 270° or less.

10. The method according to claim 1, wherein the case-packer includes a robotic arm pivotally mounted in a central location with respect to the case-blank magazines.

11. A method of concurrently collecting a plurality of different product ensembles and sequentially packing cases thereof, comprising:

(a) concurrently collecting a plurality of different product ensembles utilizing a plurality of product conveyer lines, each of which is adapted to separately convey distinct products to one or more transfer points on individual production rates;

(b) sequentially transferring different product ensembles from the conveyer lines to a case-packer, the case-packer including a packing section as well as multiple magazines for receiving different case-blanks;

(d) controlling transfer of the product ensembles to the case-packer and selection of the appropriate case-blank; and (d) operating the case-packer at a production rate higher than the collective individual production rates of the product conveyers of the system such that accumulated product in the system is depleted while the product conveyor lines are operating.

12. The method according to claim 11, utilizing at least 3 product conveyor lines and wherein the case-packer includes at least 3 case-blank magazines.

13. The method according to claim 11, utilizing at least 5 product conveyor lines and wherein the case-packer includes at least 5 case-blank magazines.

14. The method according to claim 11, wherein the case-blank magazines are arranged over an arc of less than 300°.

15. The method according to claim 11, wherein the case-blank magazines are arranged over an arc of 270° or less.

16. The method according to claim 11, wherein the case-packer includes a robotic arm pivotally mounted in a central location with respect to the case-blank magazines.

* * * * *